United States Patent [19]

Staheli

[11] Patent Number: 4,739,615

[45] Date of Patent: Apr. 26, 1988

[54] INTERNAL COMBUSTION ENGINE IN WHICH COMPRESSED FUEL MIXTURE IS COMBUSTED EXTERNALLY OF THE CYLINDERS OF THE ENGINE IN A ROTATING COMBUSTION CHAMBER

[76] Inventor: Arthur A. Staheli, 14-44 150 St., Whitestone, N.Y. 11357

[21] Appl. No.: 818,548

[22] Filed: Jan. 14, 1986

[51] Int. Cl.[4] ..... F02G 3/02

[52] U.S. Cl. ..... 670/39.6

[58] Field of Search ..... 60/39.6, 39.62; 123/222, 68

[56] References Cited

U.S. PATENT DOCUMENTS

| | | | |
|---|---|---|---|
| 709,030 | 9/1902 | McCahon | 123/222 X |
| 891,820 | 6/1908 | Cruyt | 60/39.6 X |
| 2,374,710 | 5/1945 | Smith | 123/222 X |
| 4,458,635 | 7/1984 | Beasley | 60/39.6 X |
| 4,513,568 | 4/1985 | Bajulaz | 60/39.6 |
| 4,553,385 | 11/1985 | Lamont | 60/39.6 |

FOREIGN PATENT DOCUMENTS

| | | | |
|---|---|---|---|
| 3111873 | 10/1982 | Fed. Rep. of Germany | 123/222 |
| 856477 | 3/1940 | France | 60/39.6 |
| 7929 | 6/1885 | United Kingdom | 60/39.6 |

*Primary Examiner*—Michael Koczo

*Attorney, Agent, or Firm*—Roberts, Spiecens & Cohen

[57] ABSTRACT

An engine in which a very lean mixture of fuel and air can be compressed, ignited and burned to completion outside of the cylinders of an internal combustion engine before it is introduced into a cylinder for effecting a power stroke. Two pistons operate together, piston one being for suction and piston two for power. Piston one introduces and compresses the fuel into rotating combution chambers, and piston two receives the burned fuel and air mixture to produce the power stroke. As the combustion chambers rotate, the fuel and air mixture is ignited by a glow plug. After ignition, the ignited fuel remains confined within the rotating combustion chambers to assure complete combustion. The expanded fuel powers the piston in the second cylinder and is then discharged as a clean exhaust.

21 Claims, 11 Drawing Sheets

FIG. 4
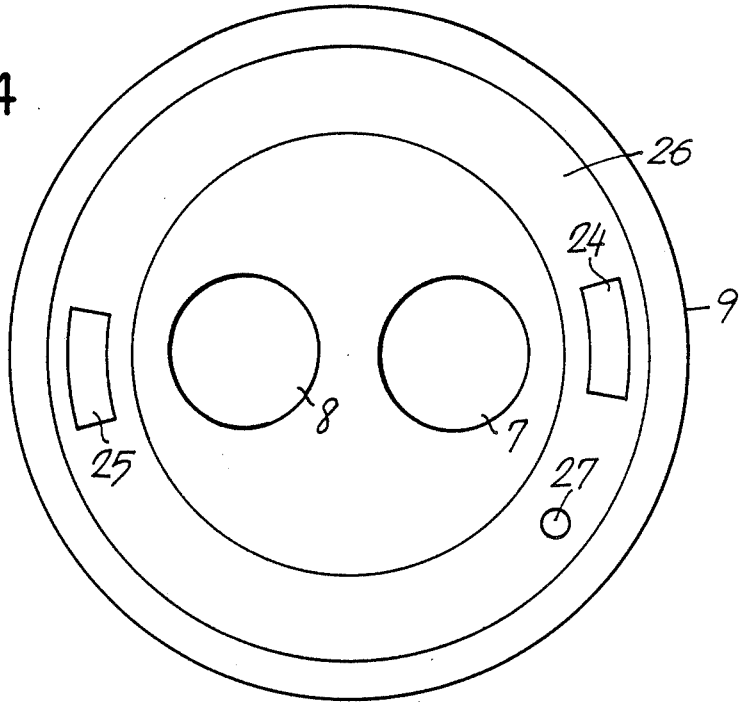
FIG. 5
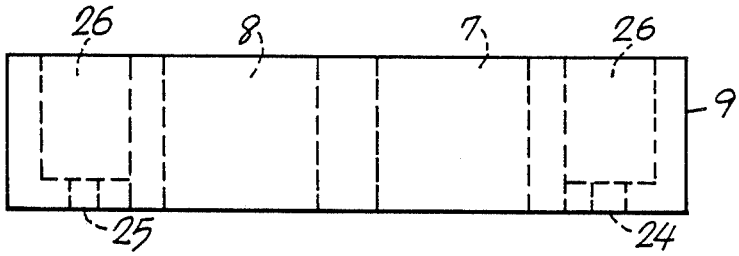
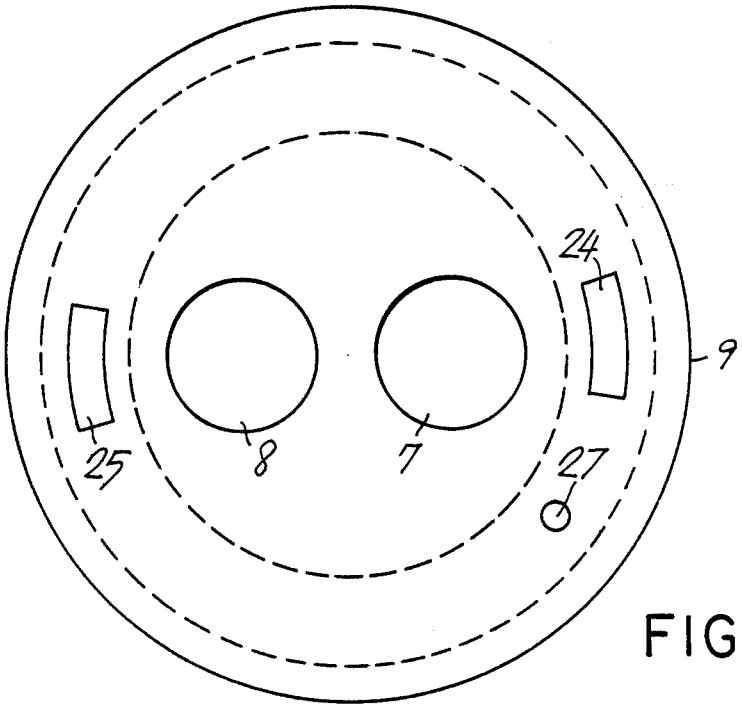
FIG. 6

INTERNAL COMBUSTION ENGINE IN WHICH COMPRESSED FUEL MIXTURE IS COMBUSTED EXTERNALLY OF THE CYLINDERS OF THE ENGINE IN A ROTATING COMBUSTION CHAMBER

FIELD OF THE INVENTION

The invention relates to improvements in internal combustion engines and particularly to methods and apparatus for the combustion of fuel externally of the cylinders of an engine.

BACKGROUND

Power sources, such as internal combustion engines and the like rely on the combustion of fuel and air as their primary source of energy.

In a standard four cycle engine, combustion occurs in the combustion chamber after the compression stroke when the fuel is ignited by various ignition methods.

The fuels that are most often used for power are hydrocarbon-based fuels such as gasoline.

The need for refinement of crude oil into the various octane levels required for present day engines is costly.

Environmental concerns require that improved efficiency and reduced emissions of harmful exhaust by-products be provided.

In present engines, when the piston reaches the top of its stroke, the fuel has been compressed and a single spark ignites the mixture of the compressed fuel and air and the speed of the flame front ignites the full mixture.

Lean air fuel mixtures do not burn well because the flame speed of the front is reduced.

The actual burning rate and ignition delay of this system depends upon the chemistry of the fuel and therefore extremely sophisticated combustion chambers have been necessary to produce slight improvements in ignition delay and burning rate.

Conventional ignition systems require relatively rich fuel mixtures for proper combustion.

Thus, the conventional ignition system and the speed of the flame front limits the useful operating range of both low and high compression engines. .

SUMMARY OF THE INVENTION

An object of the invention is to provide an internal combustion engine having a long period of time to ignite a lean mixture of fuel and air.

In accordance with the invention, the engine has front and rear cylinders with reciprocable pistons therein and a rotating combustion chamber assembly in a cylinder head, said assembly comprising six equally spaced combustion chambers in a circular housing.

The cylinder head sits atop the two cylinders and has an opening for a glow plug and two slots, one slot leading into the front cylinder, the second into the rear cylinder. The front cylinder is used for suction and compression and has only an intake valve. The rear cylinder is used for power and exhaust and has only an exhaust valve. The pistons in the front and rear cylinders move up and down together as a pair. In the bottom of each combustion chamber there is a slot extending over a length equal to one-half of the length of the chamber. This slot is the only entrance or exit into or out of the chamber. The combustion chambers are sealed by the cylinder head until they are rotated over the slots leading to the front or rear cylinder. When the slot in the combustion chamber is aligned with the slot leading to the front cylinder, the piston in the front cylinder compresses the fuel and air and supplies it to the combustion chamber. When this piston reaches the top of its compression stroke, the combustion chamber is sealed as the slot in the combustion chamber rotates to a position beyond the slot in the cylinder head. Ignition now takes place and continues until the slot in the combustion chamber passes a glow plug ending the ignition cycle for this chamber. The ignition cycle is equal to one-half a revolution of the crankshaft. Burning of the mixture continues as the sealed chamber rotates to its next position. When the fuel and air mixture is lean, a long period of time is required for complete combustion. The engine of the invention uses a lean fuel and air mixture. Each combustion chamber is designed to receive a charge of fuel and air from the piston in the front cylinder equal to its cubic inch displacement and compression ratio of its engine. Extra burning time is produced when the combustion chamber containing ignited pressurized gases rotates away from the glow plug and the gases continue to burn within the combustion chamber as it rotates. Thus, gases continue to burn within the rotating combustion chamber for a time equivalent to a rotation and one half of the crankshaft or one and a half combustion chamber lengths or three half cycles of the pistons. After complete combustion, the gases are used to power the piston in the rear cylinder.

It is to be noted that when the pistons in the cylinders are in the downstroke, two chambers are operating therebetween, one chamber undergoing ignition and burning and one undergoing burning. This gives the engine a long ignition and burning time before the sealed pressurized gas is delivered to the piston in the rear cylinder for power. Each time the pair of pistons move through the down cycle, the combustion chamber assembly rotates clockwise one half a chamber length. All chambers operate simultaneously with chamber 1 undergoing suction, chamber 2 ignition, chamber 3 burning, chamber 4 power, chamber 5 empty and chamber 6 empty. Simultaneously on the up stroke of the two pistons, all of the six combustion chambers continue to rotate in a clockwise direction onehalf of a chamber length. While the combustion chambers rotate, they undergo new functions with chamber 1 undergoing compression, chamber 2 burning, chamber 3 burning, chamber 4 exhaust, chamber 5 empty and chamber 6 empty. Thus, the functions of each of the six chambers change with each up and down cycle of the pistons. The six combustion chambers each rotate clockwise one full combustion chamber length for each complete up and down cycle of the pistons. Each combustion chamber undergoes two distinct functions in one full up and down cycle of the pistons. Table #1 herafter shows the simultaneous operation of each of the six combustion chambers. If chamber 1 is working on the up stroke piston cycle, all six chambers will be working on the up stroke cycle. If chamber 1 is working on the down stroke piston cycle, all six chambers will be working on the down stroke piston cycle. Each chamber will systematically rotate through the 12 functions during one revolution of 360 degrees as the pair of pistons move up and down.

TABLE #I

| | Combustion Chamber Functions | | | | | |
|---|---|---|---|---|---|---|
| | CC #1 | CC #2 | CC #3 | CC #4 | CC #5 | CC #6 |
| Pistons | suction | ignition | burning | power | empty | empty |

TABLE #I-continued

| | Combustion Chamber Functions | | | | | |
|---|---|---|---|---|---|---|
| | CC #1 | CC #2 | CC #3 | CC #4 | CC #5 | CC #6 |
| down cycle | | | | | | |
| Pistons up cycle | compres-sion | burning | burning | exhaust | empty | empty |

A gear incorporated in the rotating combusion chamber assembly is driven by a pinion gear which is itself driven by the crankshaft, such that the rotating combustion chamber is driven within the cylinder head in a ratio of one to six with the piston.

BRIEF DESCRIPTION OF THE FIGURES OF THE DRAWING

FIG. 4 is a top plan view of a cylinder head for receiving the rotating combustion chamber assembly.

FIG. 5 is a side view of the cylinder head of FIG. 4.

FIG. 6 is a bottom view of the cylinder head of FIG. 4.

DETAILED DESCRIPTION OF THE PREFERRED EMBODIMENT OF THE INVENTION

Figure 3:
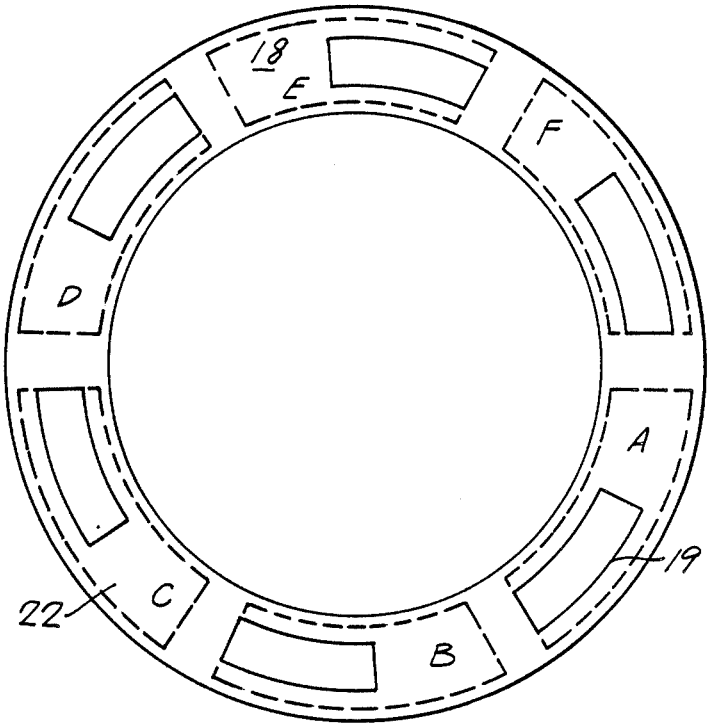
FIG. 3 is a bottom view of the assembly in FIG. 1.
Figure 2:
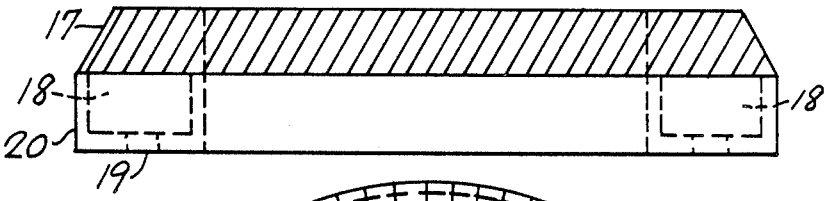
FIG. 2 is a side view of the assembly in FIG. 1.
Figure 1:
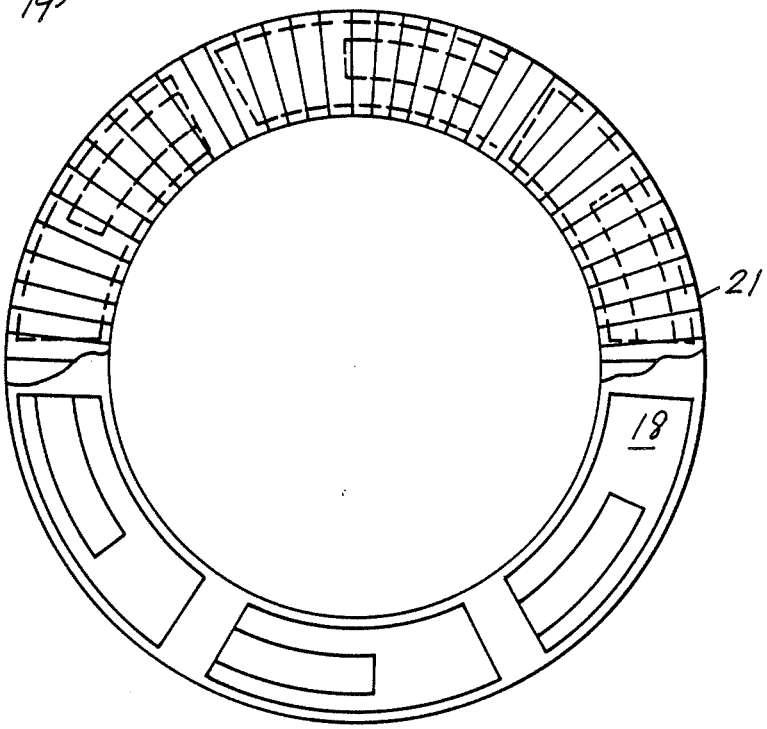
FIG. 1 is a top plan view, partially broken away, of a rotating combustion chamber assembly according to the invention.
Figure 7:
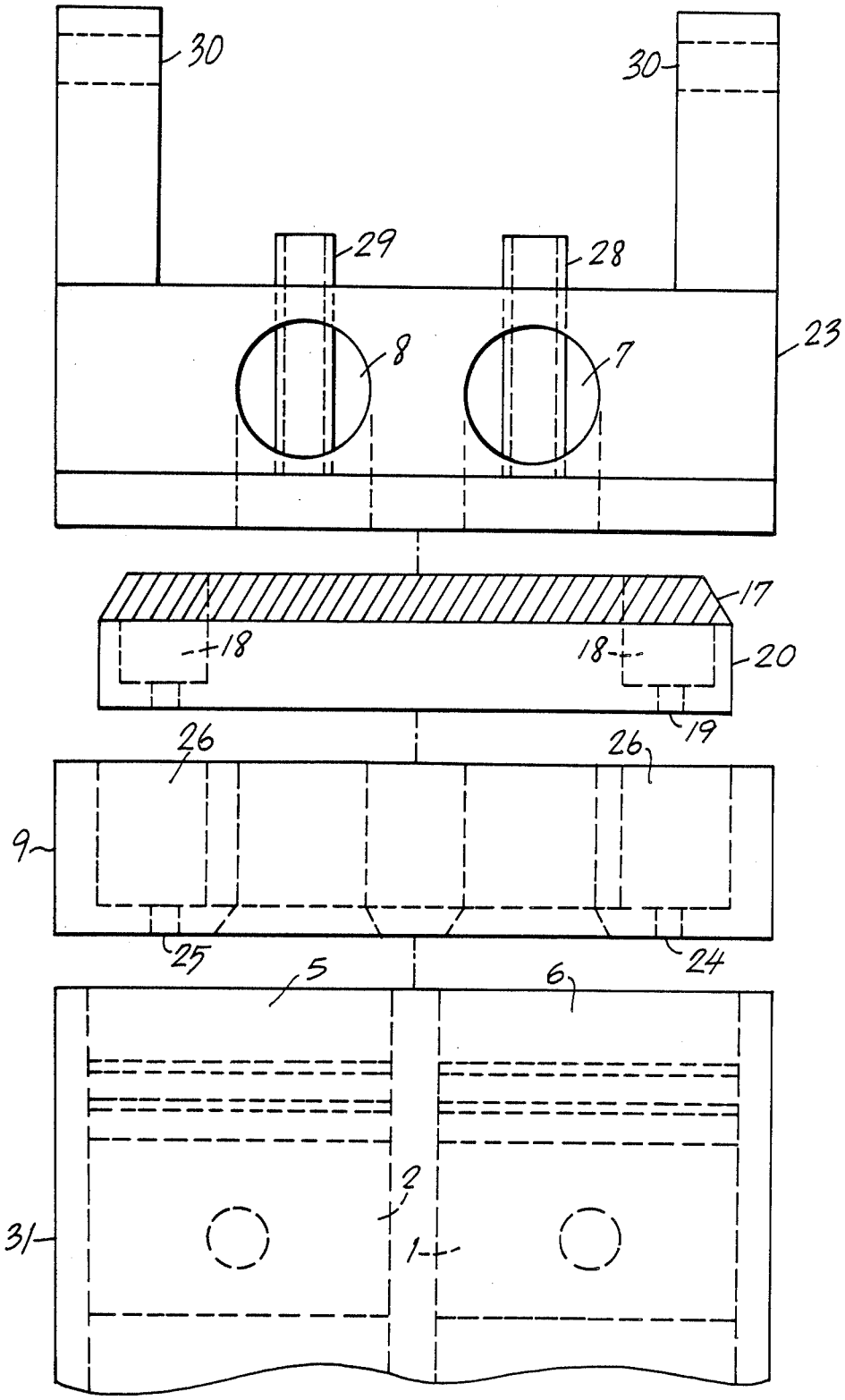
FIG. 7 is an exploded view of the components of an engine employing the rotating combustion chamber assembly.
Figure 8:
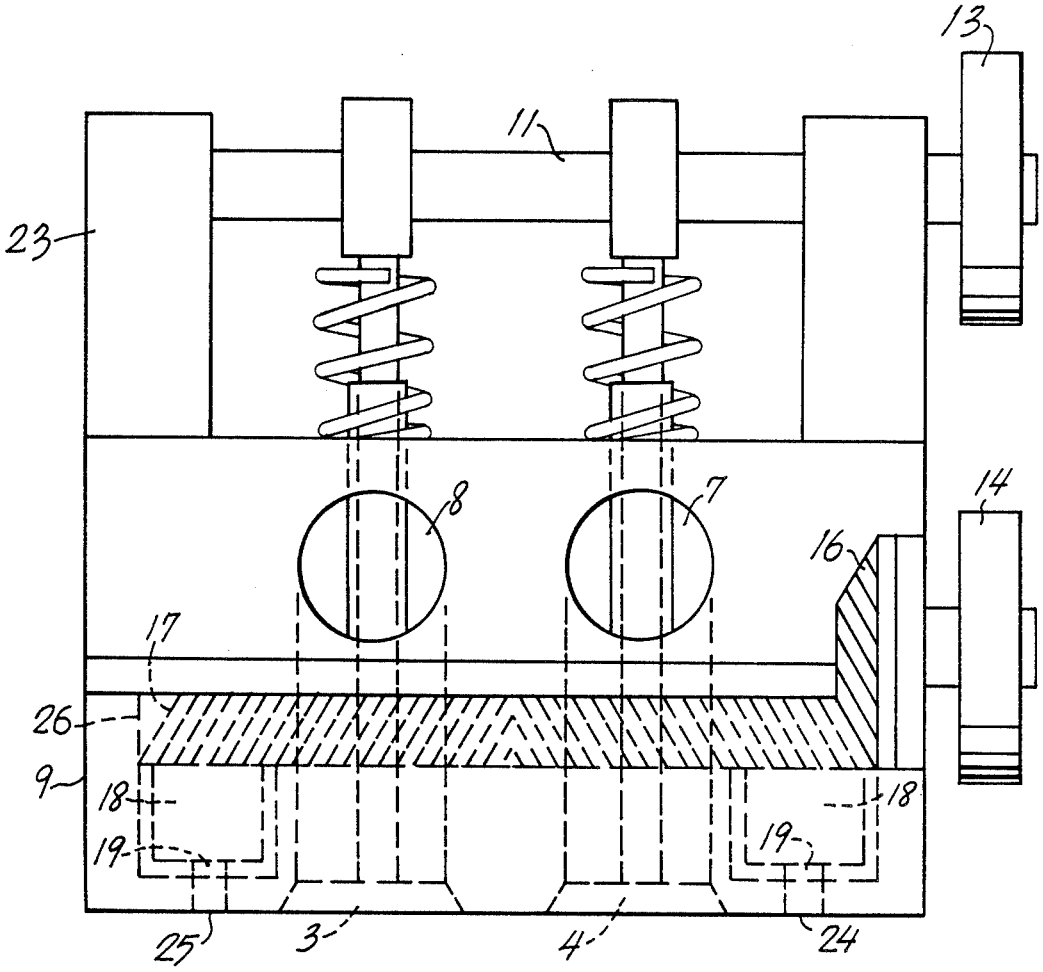
FIG. 8 is an assembly view of the components of the engine in FIG. 7 without the engine block.
Figure 9:
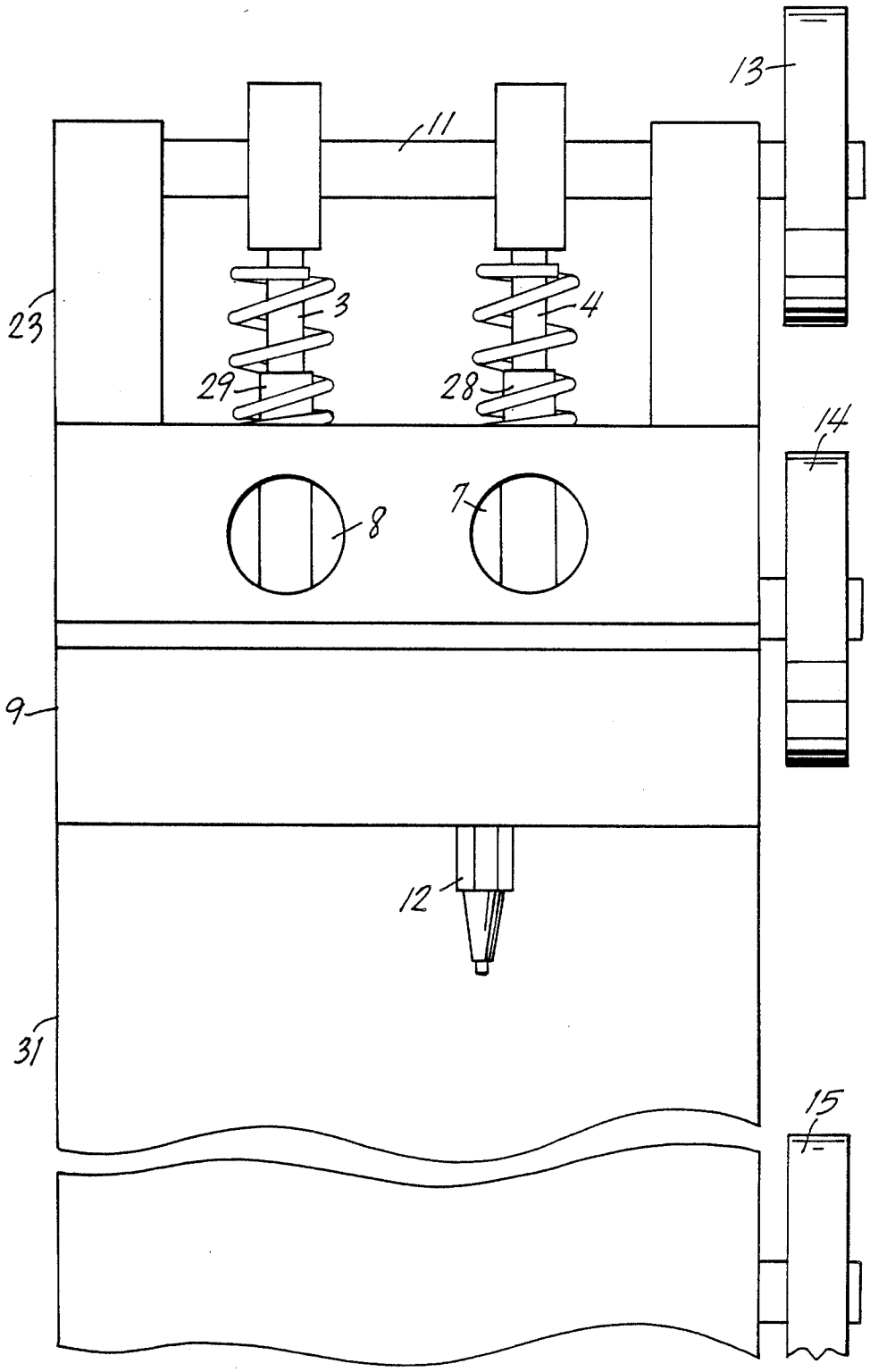
FIG. 9 is a side view of the assembly of the components of the engine in FIG. 8 including the engine block and showing a glow plug.
Figure 10:
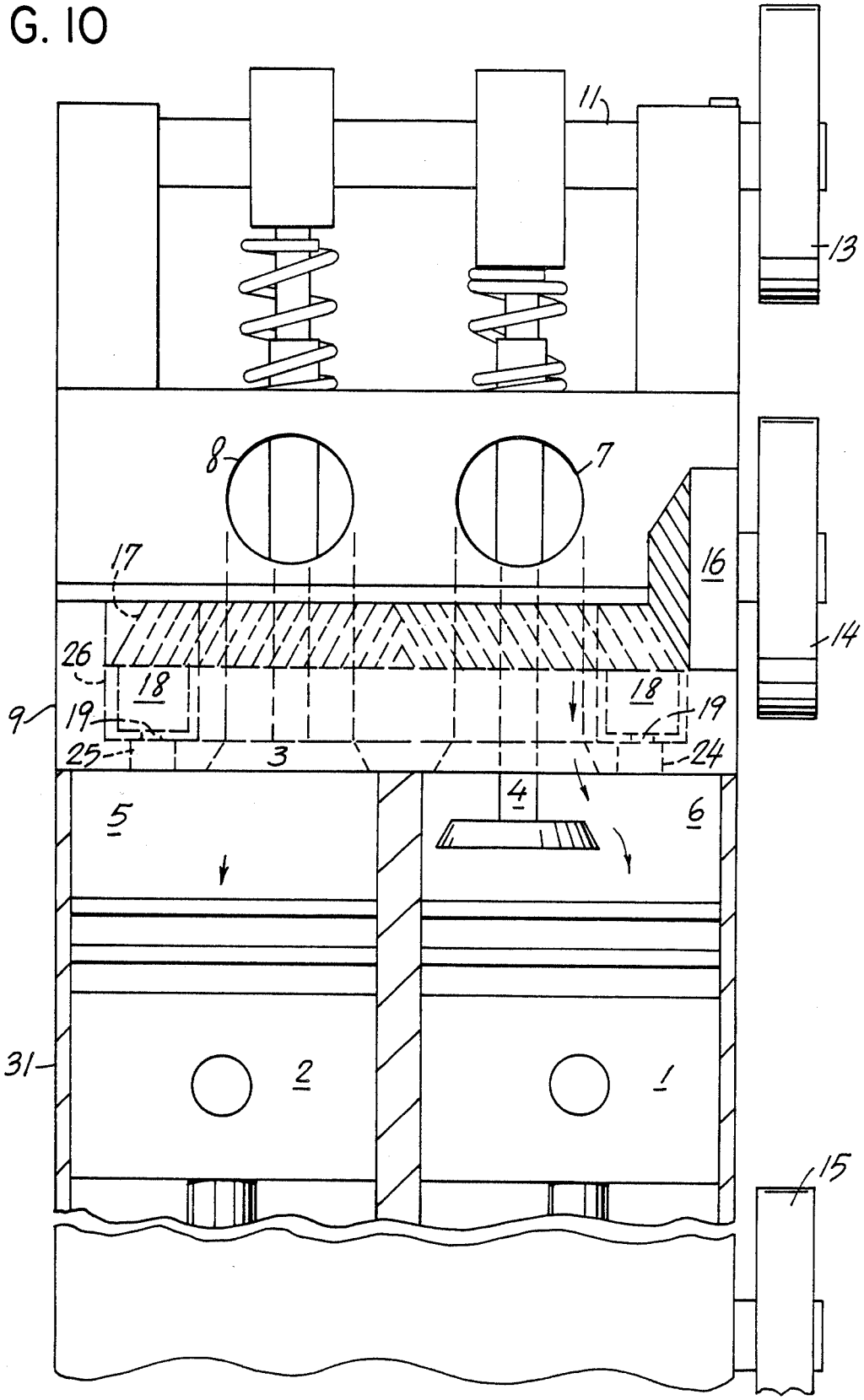
FIG. 10 is a side view similar to FIG. 9 partly broken away to show interior details in the engine block.
Figure 11:
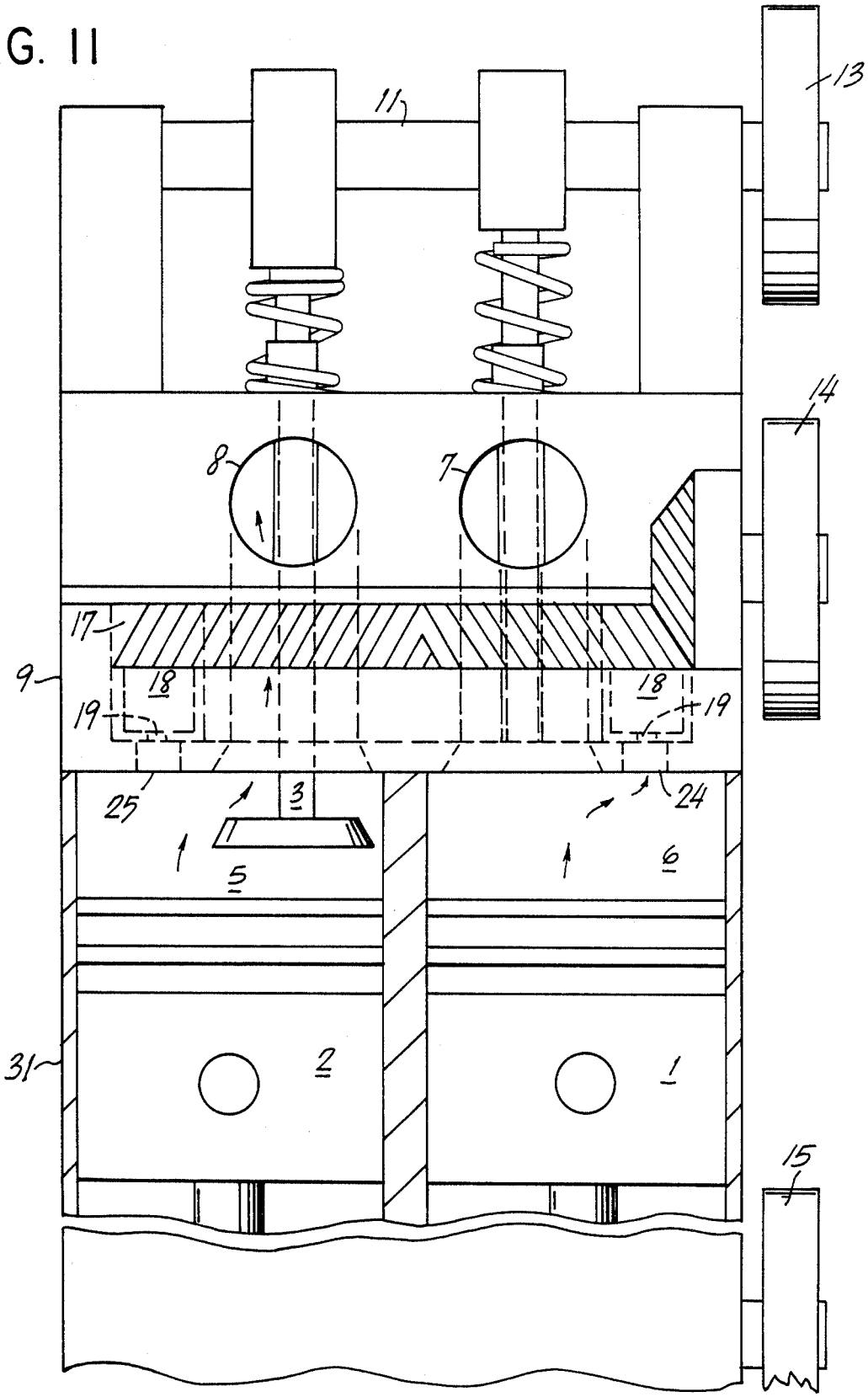
FIG. 11 is a view similar to FIG. 10 in a different stage of operation of the engine.
Figure 12:
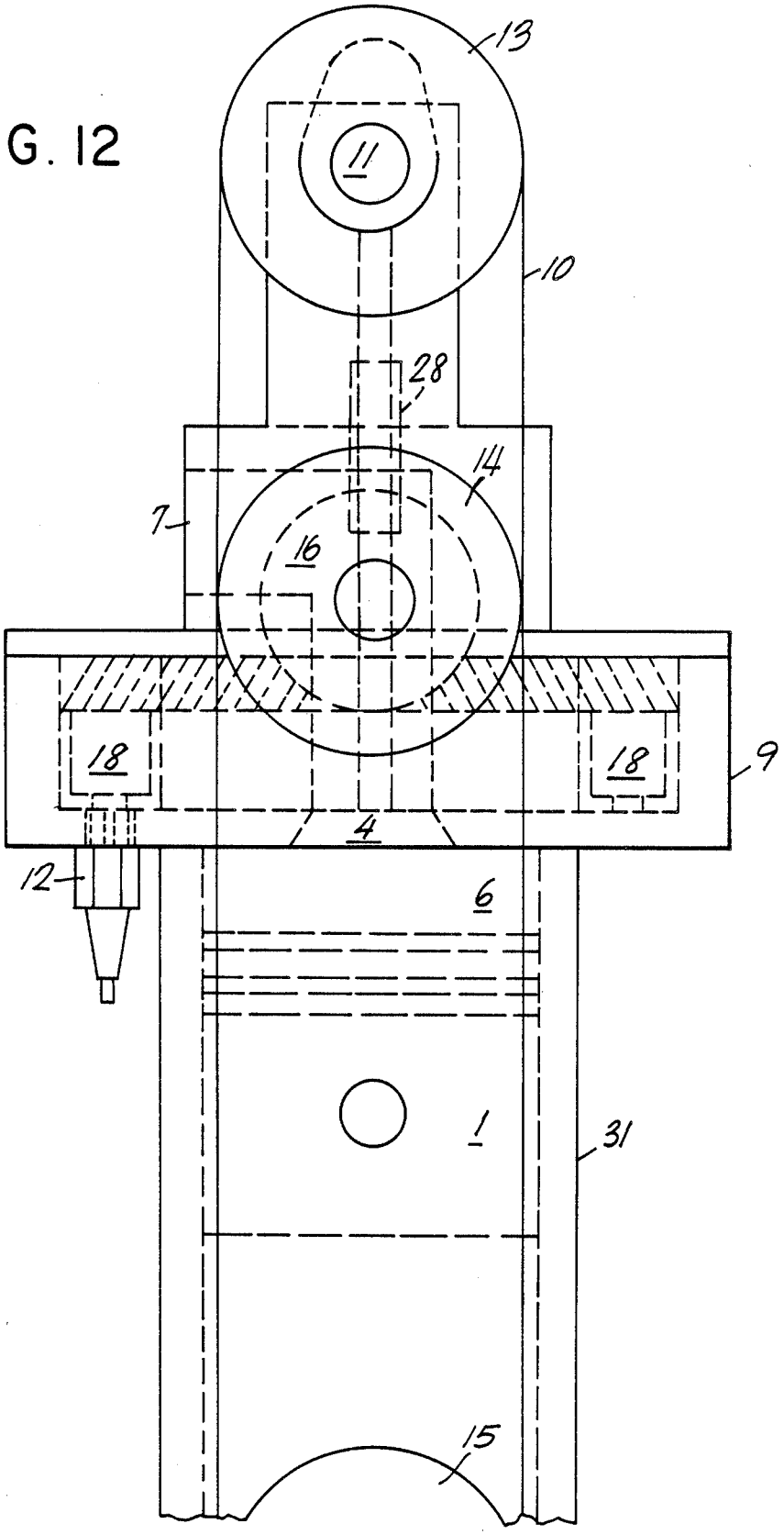
FIG. 12 is a front view of the engine.

Referring to the drawing therein is seen a cylinder block 31 of an engine in which pistons 1, 2, are reciprocable in respective rear and front cylinders 5, 6 which are adjacent one another. An exhaust valve 3 is provided at the top of cylinder 5 and an intake valve 4 is provided at the top of cylinder 6. The valves 3 and 4 respectively move between open and closed positions for the cylinders 5, 6.

In a conventional four cycle internal combustion engine, each piston produces one power stroke for two revolutions of a crank shaft. Each cylinder is provided with two valves and each piston undergoes a sequence of intake, compression, ignition and exhaust strokes.

In the engine according to the invention, the pistons 1 and 2 move up and down as a pair and each cylinder has only one valve. Cylinder 6 receives fuel mixture when valve 4 is open and piston 1 travels downwardly in a suction stroke. The fuel mixture is compressed when valve 4 is closed and the piston 1 travels upwardly in a compression stroke. Cylinder 5 is the power cylinder and travels downwardly in a power stroke after combusted fuel mixture has been introduced into cylinder 5 in a manner to be explained later. In its upward stroke, the piston 2 discharges the exhaust gases from cylinder 5 through valve 3 which is open. The piston 5 produces one power stroke for each revolution of the crank shaft.

In accordance with the invention, the compressed fuel mixture from cylinder 6 is transported externally from the cylinder 6 by a rotating combustion chamber assembly 20 in which the compressed fuel mixture undergoes ignition and combustion and the combusted fuel mixture is then delivered to the cylinder 5 to produce the power stroke therein.

The rotating combustion chamber assembly 20 comprises a cylindrical body containing six separate combustion chambers 18. The rotating combustion chamber assembly 20 is rotatably supported in a circular groove 26 provided in a cylinder head 9 mounted on the cylinder block 31. The rotating combustion chamber assembly 20 has a driven gearing 17 on its upper surface and the assembly 20 is driven in rotation by a drive pinion 16 which is in mesh in the gearing 17. The pinion 16 is driven by a sprocket 14 which, in turn, is driven from a sprocket 15 on a crankshaft (not shown) via a timing chain 10.

The sprocket 15 also drives, via timing chain 10, a sprocket 13 secured to a camshaft 11 to control the opening and closing of the valves 3 and 4. The cylinder head 9 has an intake port 7 which communicates with cylinder 6 through the valve 4 and an exhaust port 8 which communicates with cylinder 5 through valve 3.

The cylinder head has two diametrically opposed slots 24, 25 which open into the circular groove 26. Slot 24 communicates with cylinder 6 and slot 25 communicates with cylinder 5.

Each of the chambers 18 has a slot 19 in the base thereof which extends over a length equal to one-half the length of the chamber. The slot 19 has one end located at the end of its associated combustion chamber. The slot 19 selectively comes into communication with the slots 24 and 25 as the combustion chamber assembly 20 rotates in the circular groove 26. In this way, compressed fuel mixture will be supplied from cylinder 6 to undergo ignition and combustion, and the combusted gases will be supplied to cylinder 5 as will be explained later in greater detail.

A glow plug or igniter plug 12 is mounted on the cylinder head 19 and faces the bottom of the combustion chamber assembly 20 through a hole 27 in the bottom of the cylinder head 19. The plug 12 ignites the compressed fuel mixture in each chamber 18 as the slot 19 in the bottom of the chamber passes over the plug 12.

A top or cover 23 is secured on the cylinder head 9 and the combustion chamber assembly 20 rotates in groove 26 with a snug running fit between top 23 and head 9. The top 23 carries guides 28 and 29 for the intake valve 4 and the exhaust valve 3 respectively. The top 23 also carries bushings 30 for the camshaft 11.

Figure 13:
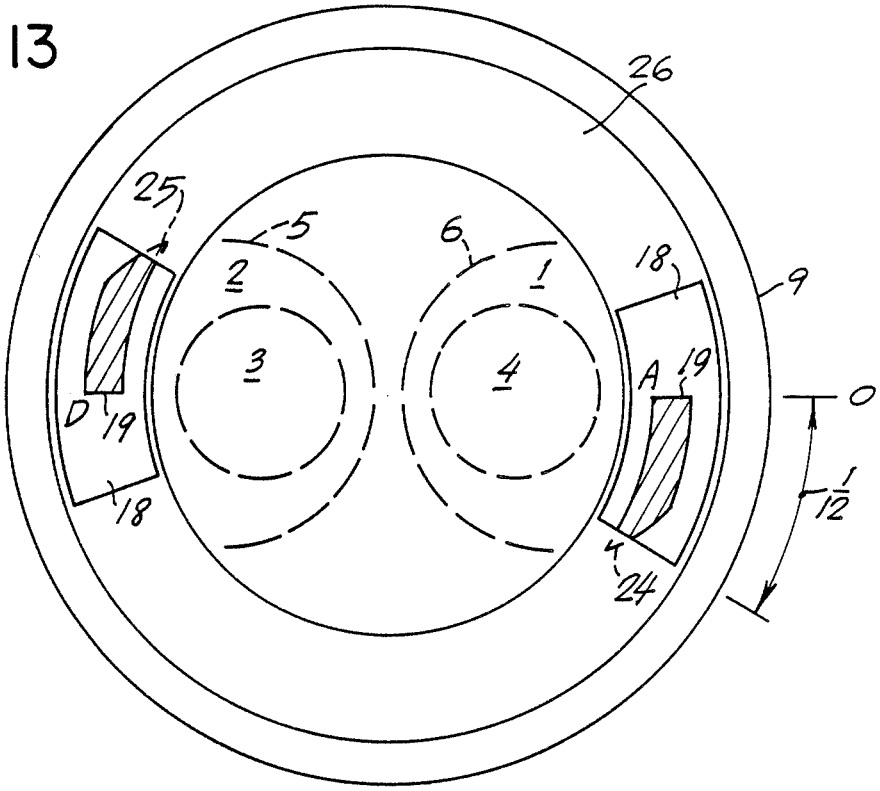
FIG. 13 is a top view which diagrammatically shows the rotating combustion chamber in a starting position.

FIG. 13 shows two diametrically opposed chambers 18 of the rotating assembly 20 in a starting position indicated at 0. The other chambers 18 have been omitted for simplicity of explanation.

Each chamber 18 is designed in size in relation to the cubic inch displacement and compression ratio of the engine. The combustion chamber assembly 20 is driven in rotation at a ratio of 1/12 with the pistons. Hence, for 1/6th of a revolution of the rotating assembly 20, the pistons 1 and 2 will have undergone one cycle consisting of one up and down stroke each.

Each chamber 18 is considered to pass through six stages designated A–F in undergoing one complete revolution. For each revolution of one chamber 18, the pistons 1, 2 will have undergone 6 cycles or reciprocations. Thus, when chamber 18 goes through any one of the stages, the pistons 1, 2 will have undergone one reciprocation. The pistons 1, 2 move together, piston 1 being for intake and compression of fuel mixture whereas piston 2 is for power and exhaust.

In the center of stage A shown in FIG. 13, slot 19 at the bottom of chamber 18 is in alignment with slot 24 and thereby is in communication with cylinder 6. The valve 4 has just closed and cylinder 6 contains a lean charge of a fuel and air mixture. As the chamber 18 moves from the position in FIG. 13 to the position in FIG. 14, i.e. from the middle of stage A to the end of stage A, the valve 4 remains closed and the piston 6 moves towards its top dead center position. The fuel and air mixture in cylinder 6 is compressed by piston 1 and forced into the combustion chamber 18. In the position shown in FIG. 14, the piston 1 is at top dead center and slot 19 has moved out of communication from slot 24. The compressed fuel and air mixture is now sealed inside chamber 18.

Figure 15:
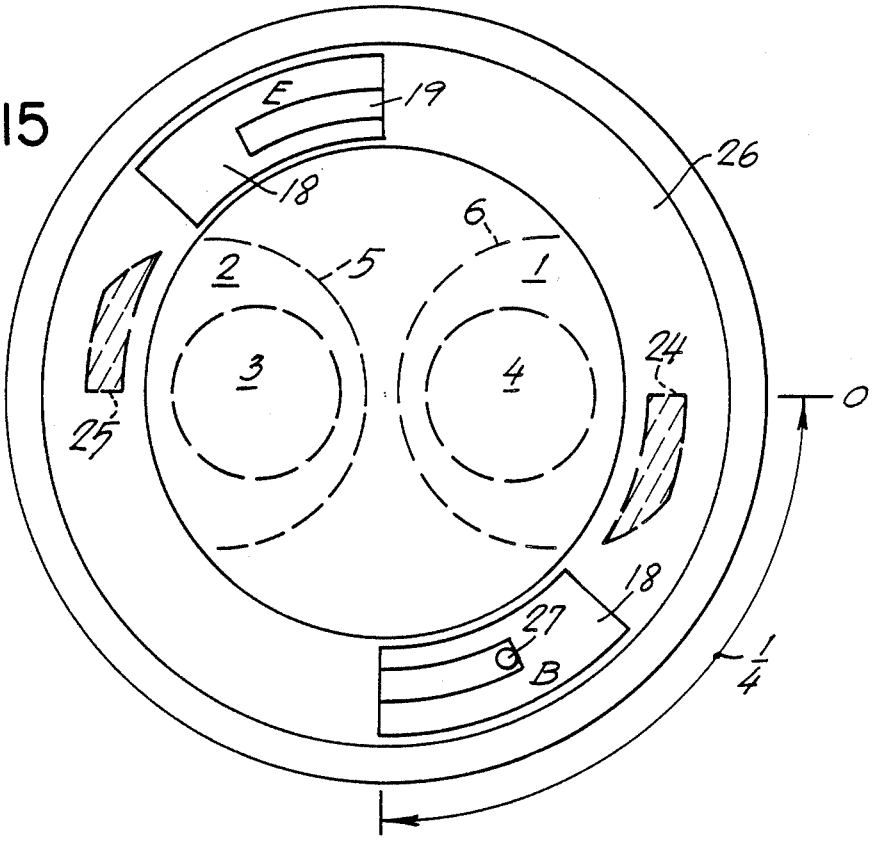
Figure 16:
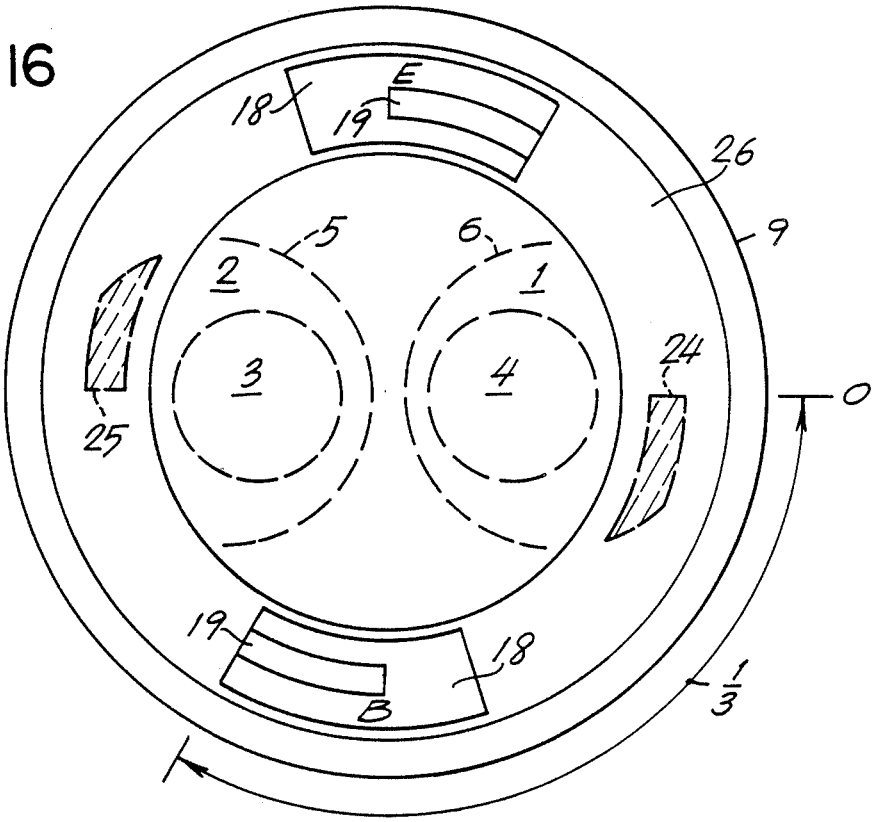
Figure 17:
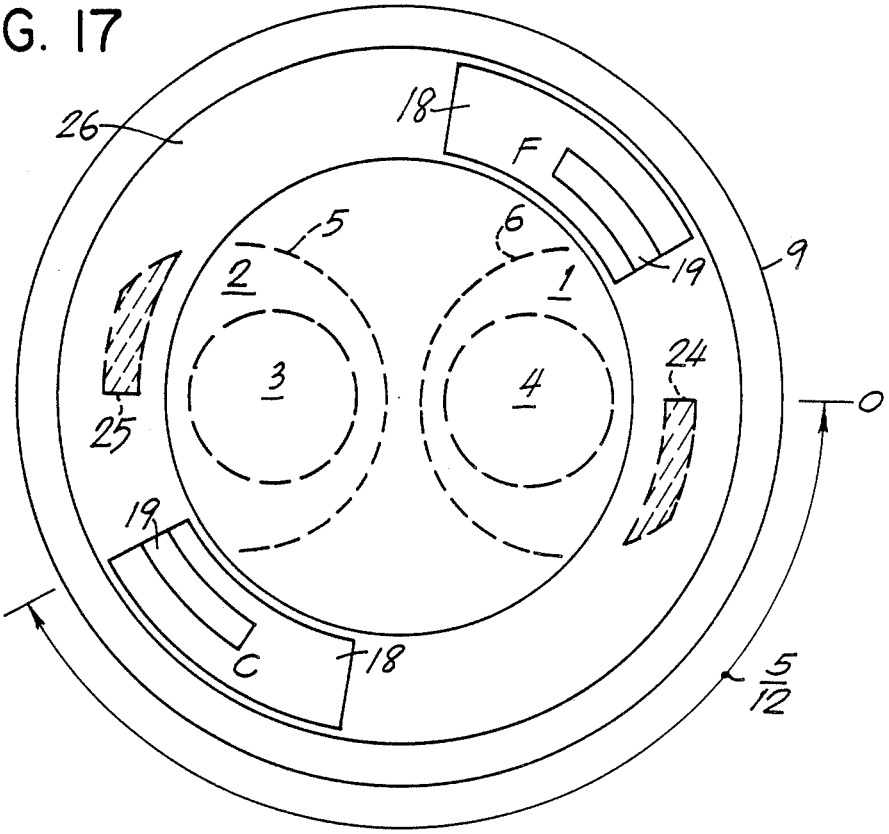
Figure 18:
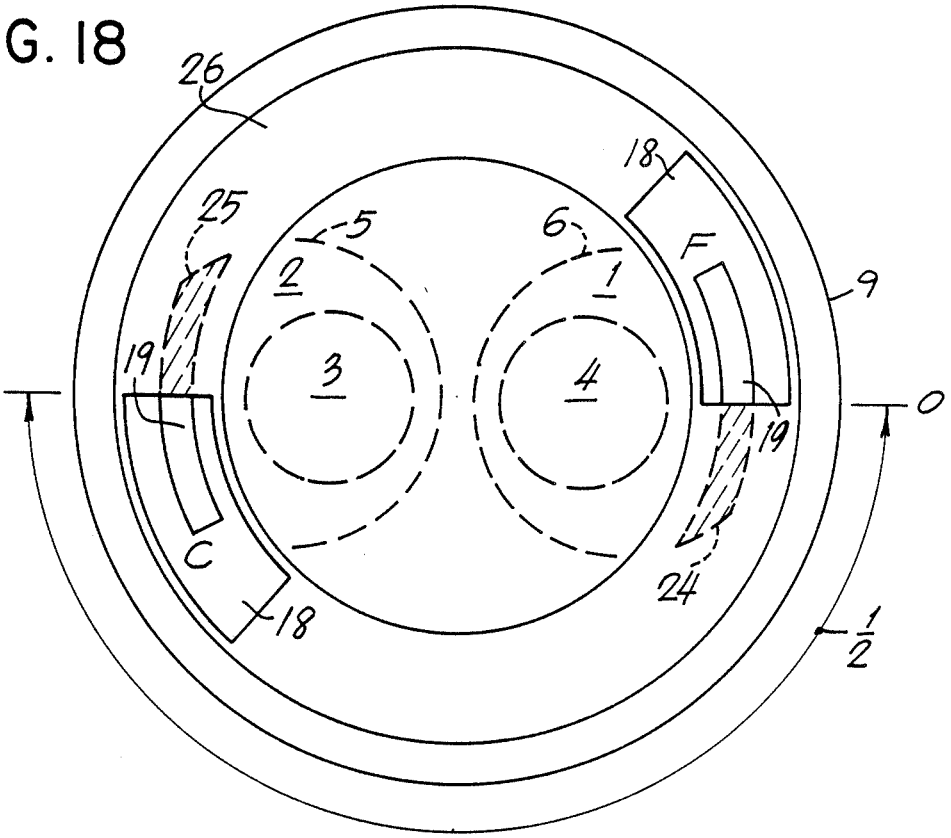

As the rotating combustion chamber assembly 20 continues its rotation to stage B in FIG. 15, valve 4 opens and piston 1 moves downwards to introduce a fresh charge of fuel and air into cylinder 6 in preparation for compressing the mixture and introducing the same into the next chamber 18. Meanwhile, the compressed fuel and air mixture in chamber 18 travels to the middle of stage B in FIG. 15. During this travel, the slot 19 at the bottom of chamber 18 passes above the opening 27 for the plug 12 which produces ignition of the compressed fuel and air mixture. The ignition continues for the period when slot 19 at the bottom of the combustion chamber 18 communicates with plug 12 via hole 19, i.e. for 1/12 of a revolution of the combustion chamber. The ignition continues until the slot 19 moves past the glow plug. The ignited fuel in the combustion chamber 18 continues to burn. The combustion chamber 18 with its confined burning fuel moves through stage C so that the fuel burns to completion. The combusted fuel is transferred through the slot 19 into cylinder 5 when the slot 19 comes into communication with the slot 25 in the cylinder head. The fully combusted fuel will begin to be transferred to piston 2 as power when the piston is at the top of its stroke, and slot 19 begins to come into communication with slot 25 as shown in FIG. 18. At this point in the operation, the rotating combustion chamber assembly 20 has gone through one-half a revolution and the pistons have gone through three reciprocations.

Figure 14:
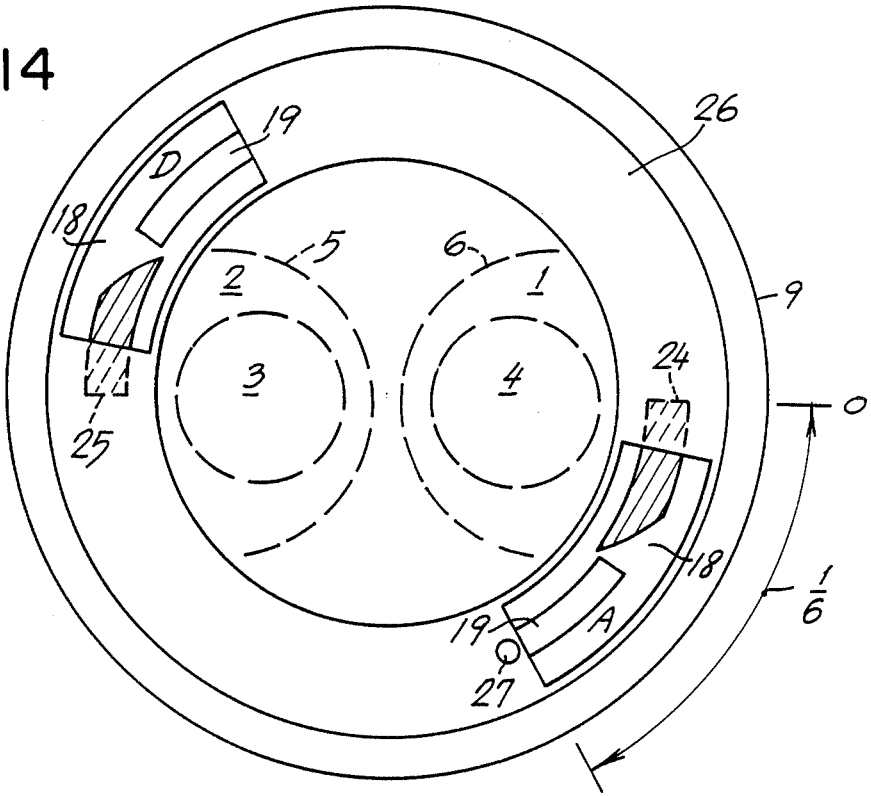
FIGS. 14–18 are similar to FIG. 13 and show the travel of the combustion chamber.

In passing into stage D, piston 2 moves downwardly in a power stroke, valve 3 being closed. In FIG. 13, the slot 19 of chamber 18 is in alignment with slot 25 in the bottom of the position in the cylinder head 9, and the piston 2 is at the bottom of its stroke. In FIG. 14 showing the chamber 18 at the end of stage D, the slot 19 has just come out of communication with slot 25 and the exhaust valve 3 closes. The now empty chamber 18 advances through stages E and F to return to the beginning of stage A where it is filled with fresh mixture and compressed by the upwardly moving piston 1 to repeat the operation.

It is to be appreciated that while the operation has been described for two opposed chambers 18, the other four chambers will be operating in pairs simultaneously, out of phase, with the described chambers.

Thus, for each complete revolution of the rotating combustion chamber assembly 20, the following operations take place.

After 1/6 of a revolution, compressed fuel mixture is sealed in chamber 18, pistons 5 and 6 are at the top of their strokes, piston 5 having just completed a compression stroke and piston 6 an exhaust stroke. The combustion chambers are in the position shown in FIG. 14.

In the next position after ¼ of a revolution as shown in FIG. 15, ignition of the compressed fuel mixture has been completed.

The ignited mixture continues to burn until the assembly has completed one-half a revolution as shown in FIG. 18, the pistons 5 and 6 being in their upper dead center positions.

During the next 1/12 of a revolution, the power stroke of piston 5 is effected, and in the subsequent 1/12 of a revolution, the exhaust gases are discharged from the chamber 18.

The empty chamber then returns to its starting position to repeat the operation.

What is claimed is:

1. An internal combustion engine comprising a cylinder body having a pair of adjoining first and second cylinders, a reciprocable piston in each cylinder, first valve means for introducing a fuel mixture in the first cylinder, second valve means for discharge of exhaust gases from the second cylinder, a combustion chamber mounted adjacent said cylinder body for movement between said cylinders and communicating in one position with said first cylinder and in a second position with said second cylinder, said combustion chamber receiving compressed fuel mixture from said first cylinder in said one position, and means for igniting the compressed fuel mixture in said combustion chamber as said chamber moves from said first to said second position, said combustion chamber delivering combusted fuel mixture to said second cylinder in said second position.

2. An internal combustion engine as claimed in claim 1 wherein said combustion chamber is rotatable.

3. An internal combustion engine as claimed in claim 2 comprising a cylinder head on said cylinder body, said combustion chamber being rotatable in said cylinder head above said cylinder body, said cylinder head having a first slot communicating with said first cylinder and a second slot communicating with said second cylinder, said combustion chamber having a respective slot which communicates with said first and second slots respectively as the combustion chamber rotates.

4. An internal combustion engine as claimed in claim 3 comprising a rotatable cylindrical body supported in said cylinder head and including said combustion chamber and a plurality of further combustion chambers, each of said further combustion chambers having a respective slot which communicates with said first and second slots in the cylinder head respectively as the cylindrical body rotates.

5. An internal combustion engine as claimed in claim 4 wherein said rotatable cylindrical body comprises a gearing secured therewith, said engine further comprising a drive pinion in driving engagement with said gearing and driven from a crankshaft of the engine.

6. An internal combustion engine as claimed in claim 4 wherein said means for igniting the compressed fuel mixture comprises an igniter plug secured in said cylinder head in a position to communicate with the slot in each combustion chamber to ignite the compressed fuel mixture therein when the combustion chamber is between the first and second slots in the cylinder head.

7. An internal combustion engine as claimed in claim 6 comprising a cover on said cylinder head and a rotatable camshaft supported by said cover for operating said first and second valve means.

8. An internal combustion engine as claimed in claim 7 wherein said cover includes guides for said first and second valve means.

9. An internal combustion engine as claimed in claim 4 wherein said combustion chambers are six in number and are equally spaced in said cylindrical body.

10. An internal combustion engine as claimed in claim 4 wherein the slot in each chamber has a length equal to one-half the length of the chamber.

11. An internal combustion engine as claimed in claim 10 wherein the slot in each chamber has one end located at one end of the chamber.

12. An internal combustion engine as claimed in claim 1 wherein said first valve means comprises a single valve.

13. An internal combustion engine as claimed in claim 1 wherein said second valve means comprises a single valve.

14. An internal combustion engine as claimed in claim 1 wherein said pistons are coupled together to move up and down together in their respective cylinders.

15. An internal combustion engine as claimed in claim 1 comprising means for synchronizing the operation of the first and second valve means with the reciprocation of the pistons in the cylinders.

16. An internal combustion engine as claimed in claim 4 comprising means for synchronizing the operation of the first and second valve means withthe reciprocation of the pistons in the cylinders, said synchronizing means comprising a timing chain driven by a crankshaft of the engine, said rotatable cylindrical body being driven from said timing chain so that when the pistons in the cylinders have moved upwardly one combustion chamber has received compressed fuel mixture from said first cylinder and combusted fuel from another combustion chamber is ready to supply power to the piston in said second cylinder.

17. A method of operating an internal combustion engine in which a cylinder body has adjoining first and second cylinders and a reciprocable piston in each cylinder, said method comprising moving the pistons in the first and second cylinders up and down together, introducing a fuel and air mixture into the first cylinder during the down movement of the piston therein, connecting a combustion chamber with the first cylinder during the next up movement of the piston therein so that said fuel and air mixture in said first cylinder is compressed and discharged into the combustion chamber, sealing and moving the combustion chamber after the combustion chamber receives the compressed fuel and air mixture, igniting the compressed fuel and air mixture in the sealed combustion chamber during movement thereof to cause combustion of the fuel and air mixture in the combustion chamber, introducing the thus combusted fuel and air mixture from the combustion chamber into the second cylinder to cause the piston in the second cylinder to move down in a power stroke and discharging the fuel and air mixture as exhaust gases from the second cylinder during the next up movement thereof.

18. A method as claimed in claim 17 in which said combustion chamber is moved by rotating said combustion chamber along a path so that it periodically comes into communication with said first and second cylinders.

19. An internal combustion engine as claimed in claim 18 wherein a complete revolution of said combustion chamber from said first cylinder and back thereto, said combustion chamber successively undergoes filling with compressed fuel and air mixture, igniting of said fuel and air mixture, burning of said mixture, and discharging of the burned mixture to the second cylinder.

20. A method as claimed in claim 19 wherein after the discharge of the burned mixture from the combustion chamber to the second cylinder, the combustion chamber remains empty until it reaches the first cylinder and is supplied with compressed mixture.

21. A method as claimed in claim 19 wherein during a complete revolution of the combustion chamber, the pistons in the first and second cylinders reciprocably move together, the piston in the first cylinder successively producing suction of said mixture during the downstroke and compression of the mixture during the upstroke while the piston in second cylinder successively produces power during the downstroke and exhaust during the upstroke.

* * * * *